US006494155B2

(12) United States Patent
Gibson

(10) Patent No.: US 6,494,155 B2
(45) Date of Patent: Dec. 17, 2002

(54) THREE PILING BOAT LIFT

(76) Inventor: Randolph P. Gibson, 2668 Waxwood Ct., Clearwater, FL (US) 33761

( * ) Notice: Subject to any disclaimer, the term of this patent is extended or adjusted under 35 U.S.C. 154(b) by 0 days.

(21) Appl. No.: 09/681,095

(22) Filed: Jan. 3, 2001

(65) Prior Publication Data

US 2002/0083876 A1 Jul. 4, 2002

(51) Int. Cl.[7] ..... B63C 1/02
(52) U.S. Cl. ..... 114/44; 405/3; 114/48
(58) Field of Search ..... 114/44–51; 405/3–7

(56) References Cited

U.S. PATENT DOCUMENTS 1,061,213 A * 5/1913 Arbuckle ..... 114/48
6,230,639 B1 * 5/2001 McLaughlin et al. ..... 114/44

* cited by examiner

*Primary Examiner*—Ed Swinehart
(74) *Attorney, Agent, or Firm*—Ronald E. Smith; Smith & Hopen, PA

(57) ABSTRACT

The cost of building a five thousand pound boat lift is substantially cut in half by using three pilings instead of four. The three pilings include a pair of outboard pilings and a single inboard piling. A boat-supporting cradle includes a leading frame member having an outboard end positioned near a leading piling of the pair of outboard pilings and an inboard end positioned near the single inboard piling. A trailing frame member has an outboard end positioned near a trailing piling of the pair of outboard pilings and an inboard end positioned near the single piling. A longitudinally disposed brace interconnects the leading and trailing frame members near their respective outboard ends and a longitudinally disposed plate interconnects the frame members near their respective inboard ends. An equalizer assembly is pivotally mounted to the plate and opposite ends of the equalizer assembly are connected by separate cables to a winch that surmounts the single piling. Another winch surmounts the pair of outboard pilings and supports separate cables that engage pulleys mounted to the respective free ends of the leading and trailing frame members. The winches lift a five thousand pound cradle-supported boat from the water and the equalizer assembly prevents the cradle from rotating about its transverse axis even though it is supported by only three pilings.

9 Claims, 5 Drawing Sheets

26
4
4
40
38
3
3
42
16
26
19
18b
30b
29
18
30
31
30a
29
6
6
28b
29
28
28a
31
5
5
19
18a
29
22
32
34
36
32

THREE PILING BOAT LIFT

BACKGROUND OF INVENTION

1. Field of the Invention

This invention relates, generally, to boat lifts. More particularly, it relates to a boat lift that requires fewer pilings than a conventional boat lift.

2. Description of the Prior Art

A boat is typically lifted from water by positioning a cradle below the surface of the water, positioning a floating boat above the cradle, and lifting the cradle out of the water. A typical cradle is square or rectangular in configuration, and typically includes a pair of longitudinally disposed, transversely spaced apart frame members that are interconnected to one another at their respective opposite ends by transversely disposed braces. Cable-engaging pulleys are mounted at opposite ends of each frame member and overhead winches, mounted on pilings or other suitable support surfaces, are used to raise and lower the frame members.

A conventional boat lift includes four pilings that are driven into a sea bed adjacent a pier, wharf, or dock in a generally square or rectangular array. A first set of two pilings is positioned close to the dock and the second set of two pilings is positioned away therefrom by a distance substantially equal to the width of a boat and a reasonable amount of clearance space. A first winch surmounts the first or inboard set of pilings and a second winch surmounts the second or outboard set.

A boat is positioned between the inboard and outboard pilings such that its longitudinal axis is substantially parallel to a first centerline drawn through the first set of pilings and therefore substantially parallel to a second centerline drawn through the second set of pilings.

Pile driving is an expensive and time-consuming procedure. When the cost of winches, cables, pulleys and motors is added to the cost of the pilings and the boat cradle, a boat lift capable of lifting a five thousand pound boat from the water can cost about twenty five hundred dollars. Consumers will pay only about three thousand for such lifts; accordingly, the profit margin is low and as a result few companies are willing to serve the market. Profit margins increase as the pilings and winches become larger and more powerful, respectively, so most companies serve boat owners having large vessels. Clearly, there is a need for a boat lift that substantially reduces the cost of a five thousand pound boat lift.

However, in view of the prior art in at the time the present invention was made, it was not obvious to those of ordinary skill in the pertinent art how such a boat lift could be built.

SUMMARY OF INVENTION

The longstanding but heretofore unfulfilled need for a boat lift of substantially reduced manufacturing costs is now met by a new, useful, and nonobvious boat lifting apparatus. The novel structure includes a pair of outboard pilings disposed in longitudinally spaced apart relation to one another, a single inboard piling disposed in transversely and equidistantly spaced apart relation to said pair of outboard pilings, and a cradle disposed between said pair of outboard pilings and said single inboard piling. The outboard pilings are spaced apart from the inboard piling by a distance sufficient to accommodate a boat therebetween when the longitudinal axis of symmetry of the boat is in substantially parallel relation to the outboard pilings.

A first lifting means, supported by the pair of outboard pilings, is provided for lifting an outboard end of the cradle means and a second lifting means, supported by said inboard piling, is provided for lifting an inboard end of the cradle means. In this way, a boat positioned between said pair of outboard pilings and said single inboard piling is lifted upwardly when the outboard and inboard ends of the cradle are lifted upwardly by the outboard and inboard lifting means, respectively.

The cradle includes an elongate brace, a truncate plate, a leading frame and a trailing frame. The elongate brace and the truncate plate are disposed in parallel, transversely spaced apart relation to one another. The leading frame is disposed in interconnecting relation between a first end of the elongate brace and a first end of the truncate plate, and the trailing frame is disposed in interconnecting relation between a second end of the elongate brace and a second end of the truncate plate. Accordingly, the leading and trailing frames are disposed in converging relation to one another as they extend from the outboard pilings to the inboard piling. The angle of convergence is determined by respective lengths of the elongate brace and the truncate plate.

An equalizer assembly is mounted in closely spaced, parallel relation to the truncate plate. The first lifting means is mounted on said outboard pilings and is adapted to lift respective outboard ends of the leading and trailing frame members. The second lifting means is mounted on the single inboard piling and is adapted to lift the equalizer assembly. The equalizer assembly is rotatably mounted at its mid-point to the truncate plate.

An equalizer assembly is mounted in closely spaced, parallel relation to the truncate plate. The first lifting means is mounted on said outboard pilings and is adapted to lift respective outboard ends of the leading and trailing frame members. The second lifting means is mounted on the single inboard piling and is adapted to lift the equalizer assembly. The equalizer assembly is rotatably mounted at its mid-point to the truncate plate.

The elongate brace is formed of two parts that are slideably adjustable with respect to one another and lockable into a plurality of functional positions of adjustment.

The first lifting means includes a reversible motor means and an elongate rotatably mounted drum connected in driven relation to the motor means. A first cable has a first end coiled about the drum and a second end of the first cable is secured to the first end of the leading frame. A second cable has a first end coiled about the drum, and a second end of the second cable is secured to the first end of the trailing frame so that rotation of the drum in a first direction lifts the respective first ends of the leading and trailing frame and rotation of the drum in a second direction lowers the respective first ends of the leading and trailing frame.

The second lifting means means includes a reversible motor means and a truncate rotatably mounted drum connected in driven relation to the motor means. A first cable has a first end coiled about the drum and a second end of the first cable is secured to a first end of the equalizer assembly. A second cable has a first end coiled about the drum and a second end of the second cable is secured to the second end of the equalizer assembly so that rotation of the drum in a first direction lifts said respective first ends of the leading and trailing frame and rotation of the drum in a second direction lowers the respective first ends of the leading and trailing frame.

An important object of this invention is to provide a low cost boat lift capable of lifting a five thousand pound boat.

A closely related object is to achieve the foregoing object by providing a boat lift that requires a support structure that includes only three pilings.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
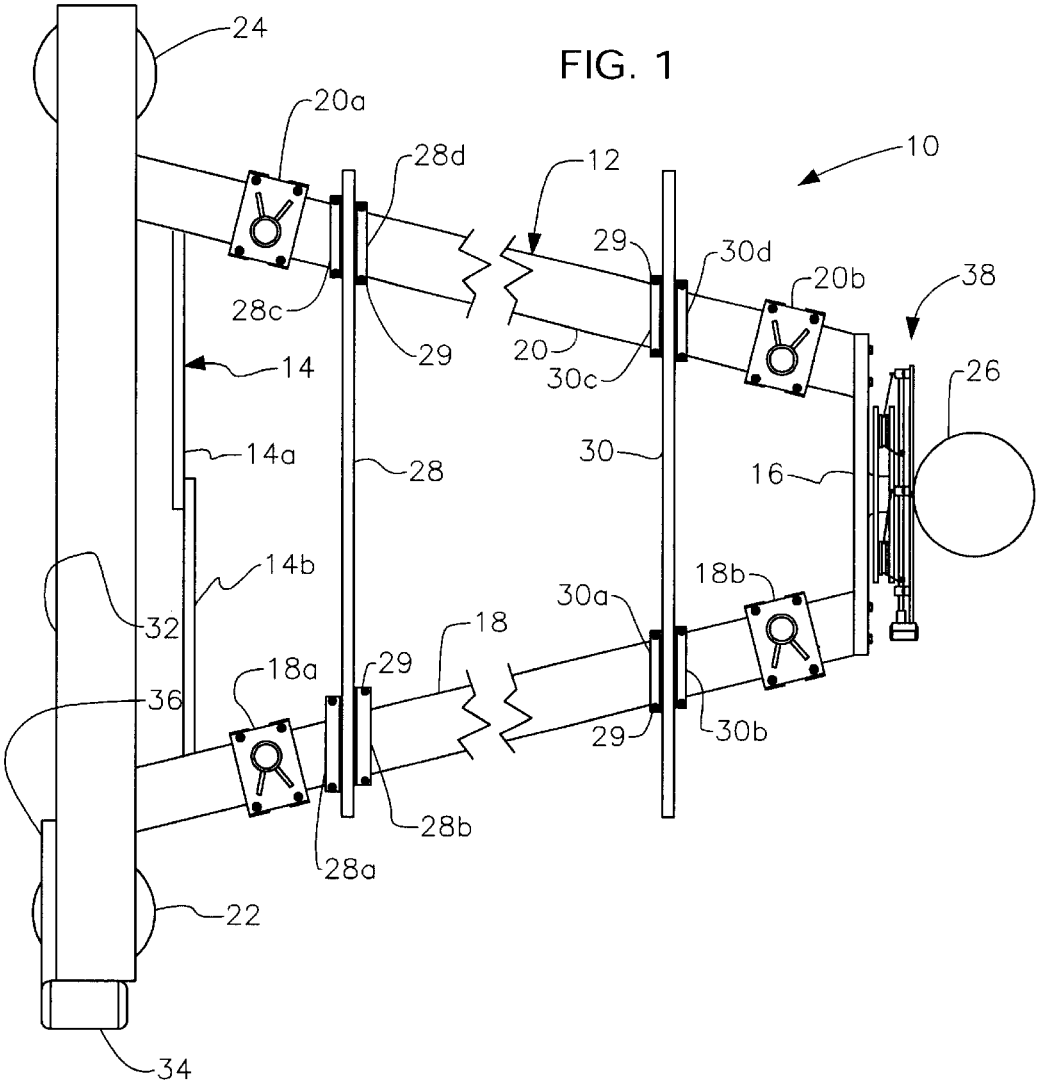
FIG. 1 is a top plan view of the novel three pier boat-lifting apparatus.

Referring initially to FIG. 1, it will there be seen that the reference numeral 10 denotes an illustrative embodiment of the present invention.

A cradle for lifting a boat is denoted 12 as a whole. Cradle 12 includes an elongate brace 14 that is transversely spaced apart from a truncate flat plate 16. Brace 14 and plate 16 are in substantially parallel relation to one another. Brace 14 interconnects first frame member 18 and second frame member 20 at or near respective first ends thereof and plate 16 interconnects first frame member 18 and second frame member 20 at their respective second ends.

Brace 14 could be a single piece that spaces said respective first ends of said first and second frames from one another in a fixed spatial relationship to one another, but in a preferred embodiment, said brace is provided in two channel-shaped parts 14*a,* 14*b* that slidingly engage one another as depicted. A plurality of longitudinally spaced apart apertures is formed in each part and first and second bolt and nut assemblies, not shown, are extended through longitudinally spaced aligned apertures to lock said parts together when a spacing between the first ends of the first and second frames has been selected.

The combined lengths of parts 14*a,* 14*b* when interconnected to one another exceed the length of truncate flat plate 16 so that first and second frames 18, 20 converge toward one another at an angle of convergence from their respective first ends to their respective second ends. Brace 14 is just a brace and the novel structure can function without it.

A pair of pilings includes pilings 22, 24 disposed in longitudinally spaced apart relation to one another. A centerline drawn through said pilings is substantially parallel to brace 14 and hence truncate flat plate 16. Pilings 22, 24 are herein referred to as outboard pilings because they are spaced apart from the dock, wharf, pier, land, or other mooring facility alongside which a boat to be lifted is moored. In FIG. 1, such facility is to the right of said FIG.

A third piling 26 is disposed in transversely and equidistantly spaced apart relation to outboard pilings 22, 24. The transverse distance between the outboard pilings and third piling 26 is preselected so that it is sufficient to accommodate a boat therebetween when the longitudinal axis of symmetry of the boat is substantially parallel to brace 14 and truncate flat plate 16. Third piling 26 is herein referred to as the inboard piling due to its close spacing to the mooring facility.

When novel apparatus 10 is to be used, cradle 12 is lowered to a position below the surface of the body of water within which a boat is floating and the boat is steered into a position above cradle 12 with the longitudinal axis of the boat being parallel to brace 14 and truncate flat plate 16. Mooring boards 28, 30, also known as bunk boards, engage the hull of the boat when cradle 12 is lifted from the water.

The transverse spacing between mooring boards 28, 30 is adjustable by moving clamp members 28*a–d* along the extent of frame members 18, 20 and clamp members 30*a–d* along said frame members, maintaining the parallel relationship between said mooring boards 28, 30. Elongate bolts, collectively denoted 29, screw-threadedly engage flanges formed in the lower end of each clamp member 28*a–d,* 30*a–d* at in upper end of said elongate bolts. The respective lower ends of said bolts screw-threadedly engage flat plates collectively denoted 31 that underlie said frame members so that tightening nuts on each bolt serves to clamp the clamp members into position. Mooring boards 28, 30 are preferably cushioned by carpeting or other suitable cushioning means.

Figure 2:
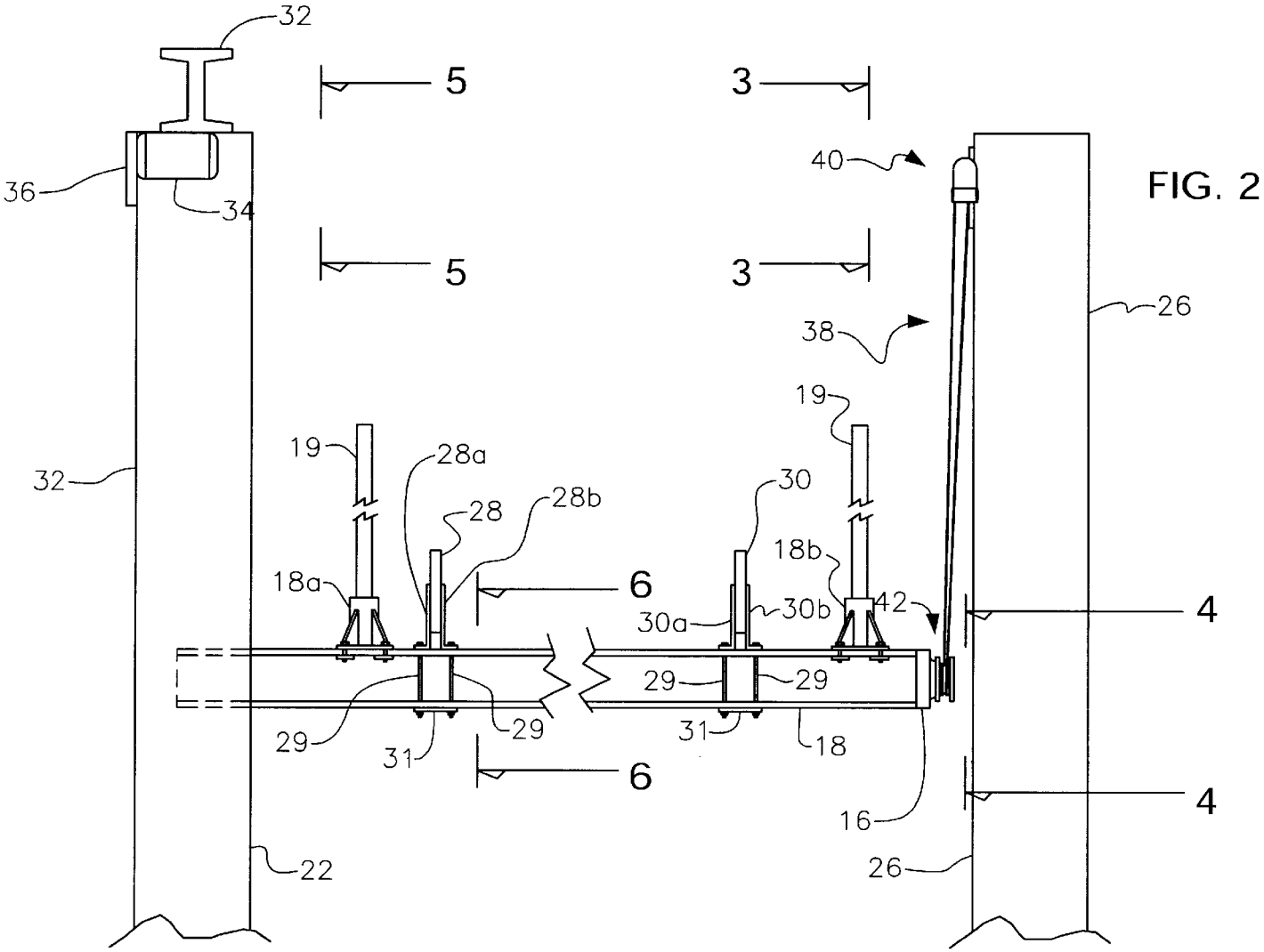
FIG. 2 is a front elevational view thereof.

Items 18*a,* 18*b,* 20*a,* and 20*b* are secured to their respective frame members 18 and 20 as indicated in FIGS. 1 and 2. They hold upstanding pipes, such as the polyvinylchloride (PVC) pipes, collectively denoted 19 in FIG. 2. Such pipes, or other suitable bumper members that do not mar a boat's surface, are used to guide a boat into proper position over lift 10.

Note that I-beam 32 surmounts outboard pilings 22, 24 and interconnects them. A reversible electric motor 34 is mounted to the leading end of said I-beam. Winch 36 is also mounted to said I-beam in driven relation to an output shaft of said motor 34. I beam 32 also supports certain parts, not shown in FIG. 1, that in conjunction with motor 34 and winch 36 perform the function of raising and lowering the outboard end of cradle 12.

Assembly 38 is mounted to inboard piling 26 and performs the function of raising and lowering the inboard end of cradle 12.

FIG. 2 depicts the novel assembly in front elevation and discloses assembly 38 in greater detail. It includes an upper assembly 40 depicted more fully in FIG. 3 and a lower assembly 42 depicted more fully in FIG. 4.

Figure 3:
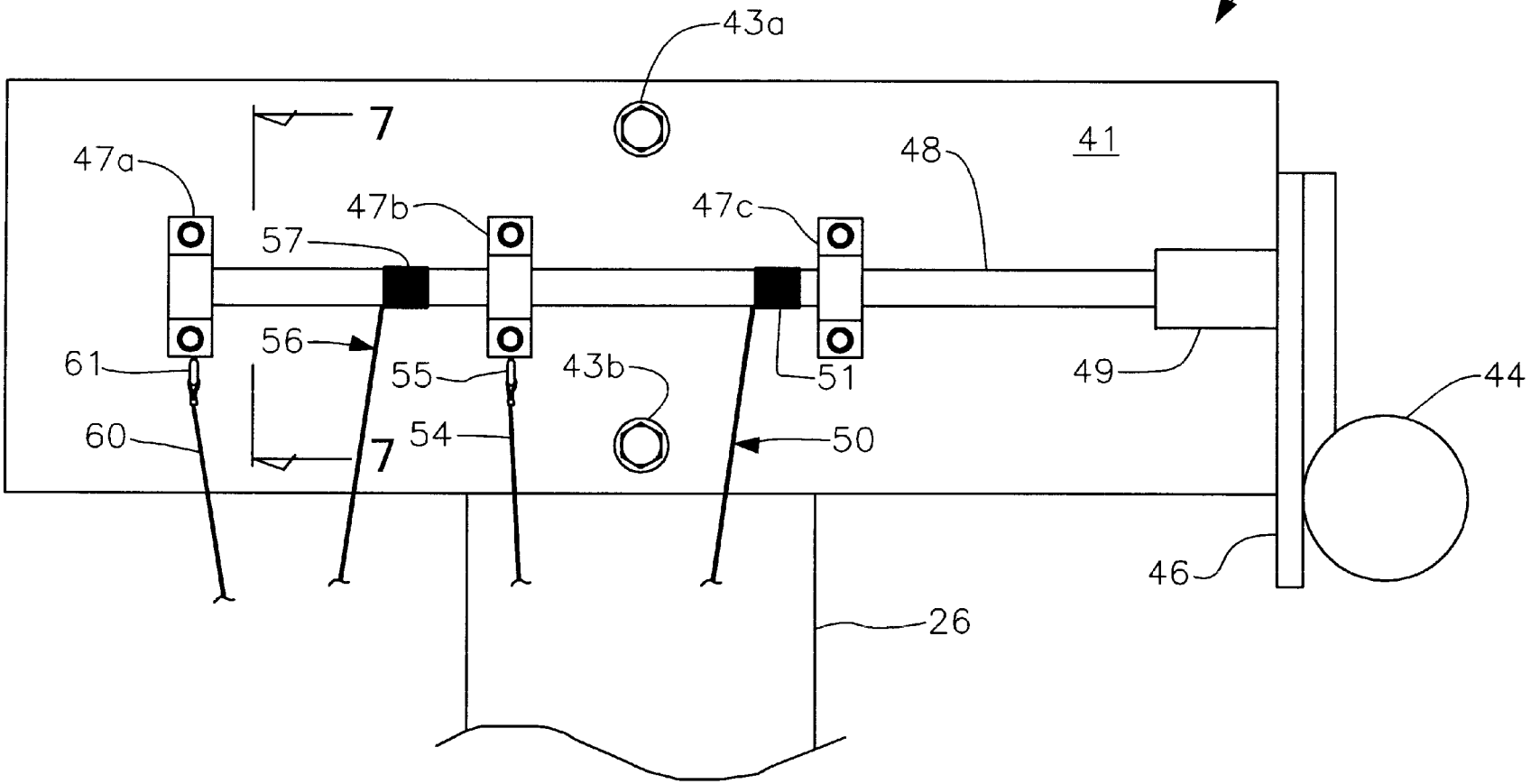
FIG. 3 is a view taken along line 3—3 in FIG. 2.

As indicated in FIG. 3, upper assembly 40 includes flat base plate 41 that is bolted as at 43*a,* 43*b* to the upper end of inboard piling 26. Reversible electric motor 44 is connected in driving relation to winch 46. Rotatable drum 48 is mounted for rotation in spaced apart relation to base plate 41 by plural, longitudinally spaced apart mounting blocks, collectively denoted 47, and boss means 49 that forms a part of winch 46.

Figure 4:
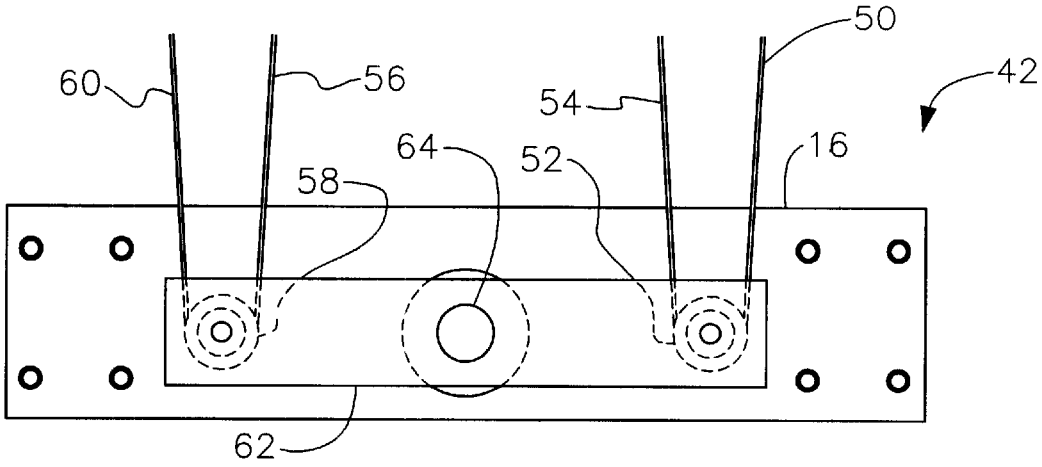
FIG. 4 is a view taken along line 4—4 in FIG. 2.

First inboard cable 50 has a first end 51 wound about rotatable drum 48 and an unnumbered lower end that extends around pulley 52 (FIG. 4). Second end 54 of inboard cable 50 is secured by clip 55 to mounting block 47*b*. Similarly, second inboard cable 56 has a first end 57 wound about rotatable drum 48 and an unnumbered lower end that extends about pulley 58 (FIG. 4). Second end 60 of second inboard cable 56 is secured by clip 61 to mounting block 47*a*. Accordingly, rotation of winch 46 and hence rotatable drum 48 in a first direction lifts the inboard end of cradle 12 and rotation of said rotatable drum in an opposite direction lowers said inboard end.

Pulleys 52 and 58 (FIG. 4) are mounted for rotation between a pair of transversely spaced apart plates 62*a,* 62*b,* only one of which is seen in FIG. 4 because it overlies the second plate. Those plates 62*a,* 62*b* may be fixedly secured to elongate flat plate 16. However, as indicated at 64, it is preferred that said plates 62*a,* 62*b* are rotatably mounted to said elongate flat plate 16. The pivotal interconnection between plates 62*a,* 62*b* and truncate flat plate 16 enables plates 62*a,* 62*b* to pivot about axis 64 so that cables 50 and 56 need not be precisely the same length at all times. If plates 62*a,* 62*b* and truncate flat plate 16 were rigidly interconnected, any difference in length between cables 50 and 56 would be translated into a tilting of cradle 12 when the cradle is lifted or lowered.

Figure 5:
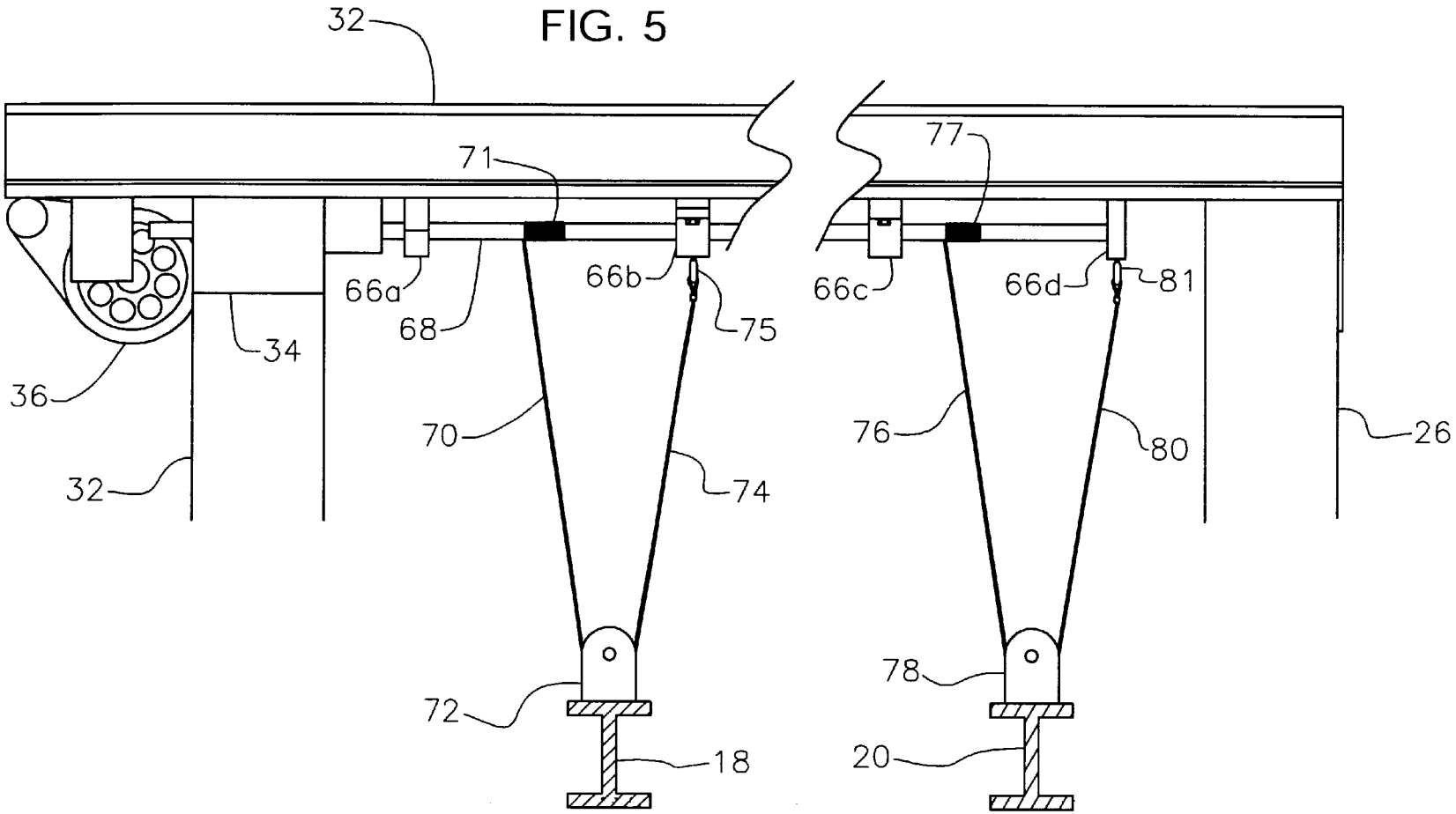
FIG. 5 is a view taken along line 5—5 in FIG. 2.

The outboard end of cradle 12 is lifted and lowered by similar means. As indicated in FIG. 5, plural mounting blocks, denoted 66*a,* 66*b,* 66*c,* and 66*d* are secured to I-beam 32 and depend therefrom to engage rotatable drum 68 at spaced intervals along its length. Drum 68 is connected in driven relation to winch 36 which is driven by motor 34 as mentioned earlier. End 71 of first outboard cable 70 is wound about drum 68 and the second end 74 of said cable is secured to mounting block 66*b* by clip 75. Cable 70 extends around pulley assembly 72 that is secured to frame 18 of cradle 12. End 77 of second outboard cable 76 is wound about drum 68 and the second end 80 of said cable is secured to mounting block 66*d* by clip 81. Cable 76 extends around pulley assembly 78 that is secured to frame 20 of cradle 12. Accordingly, rotation of winch 36 and hence rotatable drum 68 in a first direction lifts the outboard end of cradle 12 and rotation of said rotatable drum in an opposite direction lowers said outboard end.

Note that the novel structure includes four sets of cable; two on the inboard side of the structure and two on the outboard side. Accordingly, the weight lifted by the cables is distributed equally among all four cables so that all of them will have a long life. Note further that the bow-stern attitude, i.e., the pitch of the boat, may be changed by lengthening or shortening one of the cables on the outboard (water) side of the novel assembly. It should also be noted that drums 48 and 68 enable their respective cables to spool therearound along a linear path of travel and that the lowermost end of all four cables is rotatably mounted to a shiv. This enables the boat lift and boat carried thereby to travel forwardly or rearwardly while lifting and lowering, in the direction of the spooling of the cable about said drums.

Figure 7:
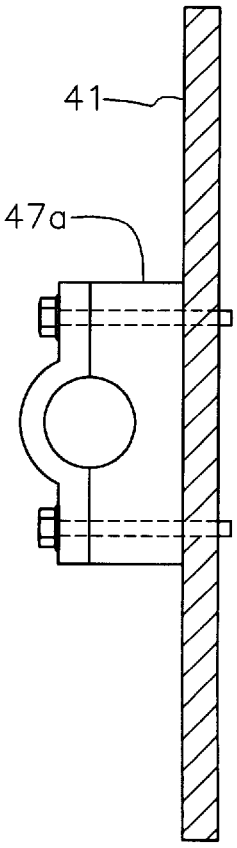
FIG. 7 is a view taken along line 7—7 in FIG. 3.
Figure 6:
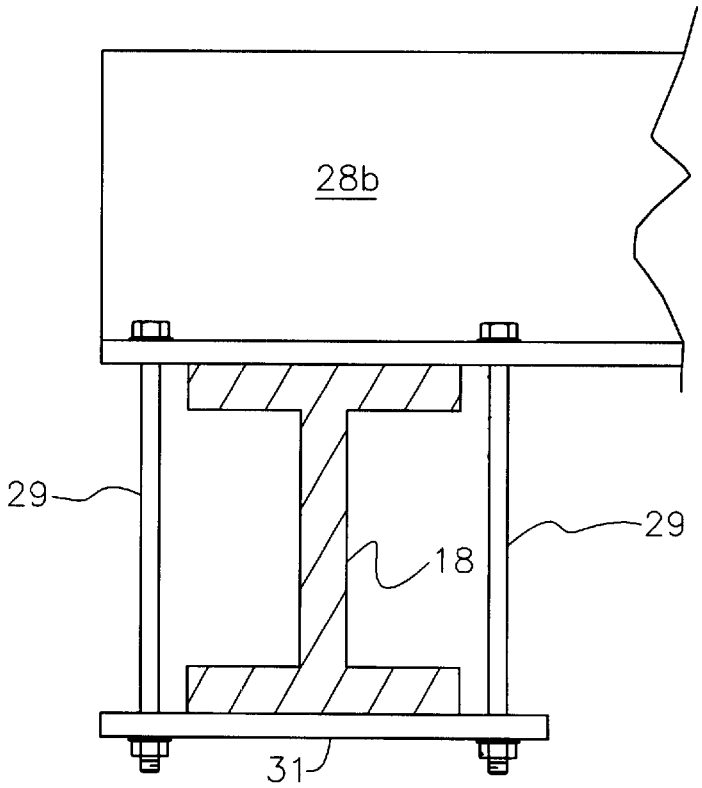
FIG. 6 is a view taken along line 6—6 in FIG. 2.

The parts detailed in FIG. 6 were described in connection with the description of FIG. 1 and the parts detailed in FIG. 7 were described in connection with the description of FIG. 3.

There are many other mechanical means that may be employed to lower cradle 12 into the water so that a boat may enter into floating relation above it and to lift the cradle and hence the boat from the water so that the boat and cradle may be protected from the deleterious effects of the water when not in use. The lifting means may be mounted to a piling, dock, pier, wharf, seawall or other suitable mounting means. The preferred embodiment depicted and described herein is merely one of the ways whereby the lifting and lowering of cradle 12 may be accomplished, and all equivalent means of performing the same function are within the scope of this invention.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A boat lifting apparatus, comprising:

a pair of outboard pilings disposed in longitudinally spaced apart relation to one another;

a single inboard piling disposed in transversely and equidistantly spaced apart relation to said pair of outboard pilings;

a cradle disposed between said pair of outboard pilings and said single inboard piling;

said cradle including an elongate brace, a truncate plate, a leading frame and a trailing frame;

said elongate brace and said truncate plate being disposed in parallel, transversely spaced apart relation to one another;

said leading frame disposed in interconnecting relation between a leading end of said elongate brace and a leading end of said truncate plate;

said trailing frame disposed in interconnecting relation between a trailing end of said elongate brace and a trailing end of said truncate plate;

said leading and trailing frames being disposed in converging relation to one another as they extend from said first and second pilings to said third piling, an angle of convergence being determined by respective lengths of said elongate brace and said truncate plate;

said pair of outboard pilings being spaced apart from said single inboard piling by a distance sufficient to accommodate a boat therebetween when the longitudinal axis of symmetry of said boat is in substantially parallel relation to said pair of outboard pilings;

a first lifting means, supported by said pair of outboard pilings, for lifting an outboard end of said cradle;

an equalizer assembly, having a leading end and a trailing end, being rotatably mounted to said truncate plate in closely spaced, parallel relation thereto;

said first lifting means being mounted on said pair of outboard pilings and adapted to lift respective outboard ends of said leading and trailing frame members;

a second lifting means, supported by said single inboard piling, for lifting an inboard end of said cradle;

said second lifting means adapted to lift said leading and trailing ends of said equalizer assembly;

whereby a boat positioned between said pair of outboard pilings and said single inboard piling is lifted upwardly when said outboard and inboard ends of said cradle are lifted upwardly by said first and second lifting means, respectively.

2. The apparatus of claim 1, wherein said elongate brace is formed of two parts that are slideably adjustable with respect to one another and lockable into a plurality of functional positions of adjustment so that the length of said elongate brace is adjustable.

3. The apparatus of claim 1, wherein said first lifting means includes a reversible motor means, an elongate rotatably mounted drum connected in driven relation to said reversible motor means, a first cable having a first end coiled about said drum, a second end of said first cable being secured to an outboard end of said leading frame, a second cable having a first end coiled about said drum, and a second end of said second cable being secured to said outboard end of said trailing frame so that rotation of said drum in a first direction lifts said respective outboard ends of said leading and trailing frame and rotation of said drum in a second direction lowers said respective outboard ends of said leading and trailing frame.

4. The apparatus of claim 1, wherein said second lifting means includes a reversible motor means, a truncate rotatably mounted drum connected in driven relation to said reversible motor means, a first cable having a first end coiled about said drum, a second end of said first cable being secured to said leading end of said equalizer assembly, a second cable having a first end coiled about said drum, and a second end of said second cable being secured to said trailing end of said equalizer assembly so that rotation of said drum in a first direction lifts said respective leading and trailing ends of said equalizer assembly and rotation of said drum in a second direction lowers said respective leading and training ends of said equalizer assembly.

5. The apparatus of claim 1, wherein said first lifting means includes a screw drive mounted on a leading piling of said pair of outboard pilings.

6. The apparatus of claim 1, wherein said first lifting means includes a screw drive mounted on a trailing piling of said pair of outboard pilings.

7. The apparatus of claim 1, wherein said second lifting means includes a screw drive mounted on said inboard piling.

8. The apparatus of claim 1, wherein said first lifting means includes a first pair of cables, wherein said second lifting means includes a second pair of cables, and wherein said first and second pair of cables substantially equally share in lifting said boat lifting apparatus and any boat supported thereby.

9. The apparatus of claim 8, wherein a pitch of a boat supported by said boat lifting apparatus is adjustable by changing a length of a cable in said first pair of cables.

* * * * *